US007225640B2

(12) United States Patent
Douglas

(10) Patent No.: US 7,225,640 B2
(45) Date of Patent: Jun. 5, 2007

(54) TEMPORARY ORNAMENT DISPLAY APPARATUS AND METHOD

(76) Inventor: Eugene Klotz Douglas, 3412 Barbera La., Modesto, CA (US) 95356

( * ) Notice: Subject to any disclaimer, the term of this patent is extended or adjusted under 35 U.S.C. 154(b) by 0 days.

(21) Appl. No.: 11/004,464

(22) Filed: Dec. 2, 2004

(65) Prior Publication Data

US 2005/0115274 A1 Jun. 2, 2005

Related U.S. Application Data

(60) Provisional application No. 60/526,464, filed on Dec. 2, 2003.

(51) Int. Cl.
*F16B 17/02* (2006.01)
*F16B 25/00* (2006.01)

(52) U.S. Cl. ..... 63/27; 63/26; 63/30; 63/29.1; 63/31; 63/40

(58) Field of Classification Search ..... 63/27, 63/26, 30, 29.1, 40, 31
See application file for complete search history.

(56) References Cited

U.S. PATENT DOCUMENTS 1,080,735 A * 12/1913 Tolchin ..... 24/705
1,855,066 A * 4/1932 Peters ..... 63/15
1,864,371 A * 6/1932 Prussian ..... 63/29.1
1,971,265 A * 8/1934 King ..... 63/15
2,316,225 A * 4/1943 De Hoffmann et al. ..... 63/29.1
2,811,024 A * 10/1957 Thompson ..... 63/26
2,883,048 A * 4/1959 Lentz ..... 206/562
3,739,598 A * 6/1973 Postel ..... 63/29.1
4,982,581 A * 1/1991 Furuyama ..... 63/29.1
5,077,989 A * 1/1992 Dillabaugh ..... 63/29.1
5,456,095 A * 10/1995 Tawil et al. ..... 63/29.1
5,671,613 A * 9/1997 Hoover et al. ..... 63/27
5,992,177 A * 11/1999 Beard ..... 63/29.1
6,467,308 B2 * 10/2002 Butler ..... 63/26
6,499,314 B1 * 12/2002 Weinmann et al. ..... 63/26
6,568,213 B2 * 5/2003 Butler ..... 63/26
6,584,804 B1 * 7/2003 Freedman et al. ..... 63/26
6,612,132 B2 * 9/2003 Kimura et al. ..... 63/31
6,820,442 B2 * 11/2004 Kimura ..... 63/31
6,857,289 B1 * 2/2005 Cheng ..... 63/31
7,017,369 B2 * 3/2006 Roberts-Shea ..... 63/15

* cited by examiner

*Primary Examiner*—Robert J. Sandy
*Assistant Examiner*—David Reese
(74) *Attorney, Agent, or Firm*—Carr & Ferrell LLP

(57) ABSTRACT

A system and method for temporarily displaying an ornament in a jewelry article is provided. The system comprises an ornament holder configured to temporarily hold an ornament and a jewelry article attachment configured to temporarily couple the ornament holder to a jewelry article. The ornament holder and the jewelry article attachment may be coupled together or design as a one-piece configuration.

25 Claims, 8 Drawing Sheets

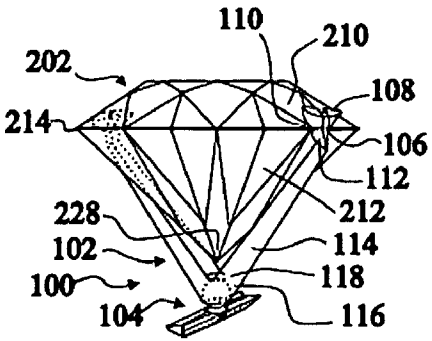
FIG. 2
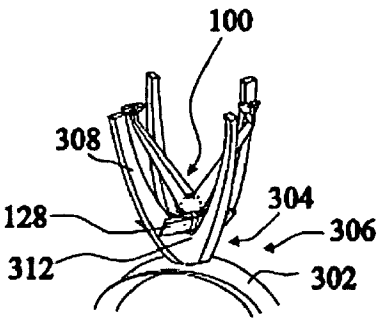
FIG. 3
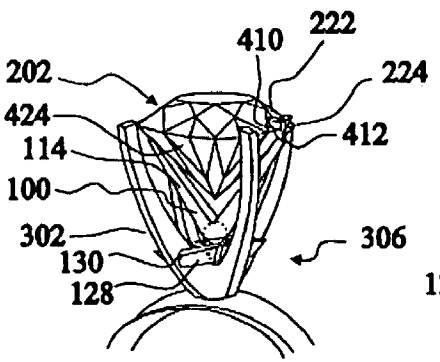
FIG. 4
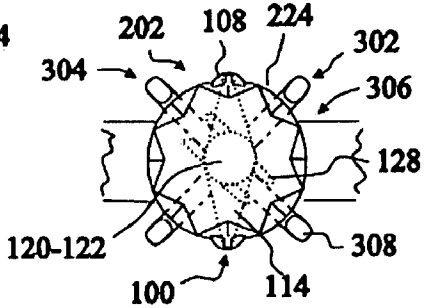
FIG. 5
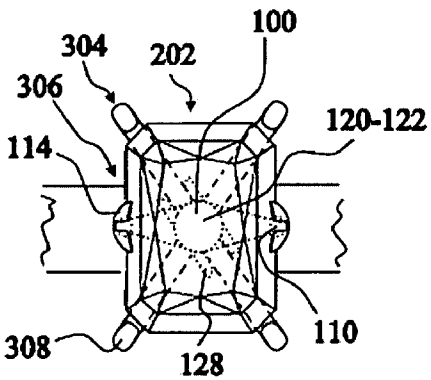
FIG. 6a
FIG. 6b
FIG. 6c
FIG. 6d

TEMPORARY ORNAMENT DISPLAY APPARATUS AND METHOD

CROSS-REFERENCE TO RELATED APPLICATIONS

The present application claims the benefit and priority of U.S. provisional patent application Ser. No. 60/526,464 filed Dec. 2, 2003 and entitled "Temporary Ornament Display Apparatus," which is herein incorporated by reference.

BACKGROUND OF THE INVENTION

1. Field of the Invention

The present invention relates generally to jewelry, and more particularly to display of loose ornaments.

2. Description of Related Art

Conventionally, jewelry stores typically maintain a partial stock of finished jewelry (i.e., a jewelry article such as a semi-mount with an ornament mounted or otherwise permanently installed thereon). These jewelry articles with ornaments installed thereon provide an aesthetically finished or complete appearance and create a more satisfying aesthetic ocular or visual appearance to many jewelry buyers.

Disadvantageously, it is not practical for jewelry stores to maintain a complete selection with every jewelry article having every type of ornament mounted thereon, as the ornaments vary in type, shape, size, and quality. Therefore, the average jewelry store normally also maintains a partial selection of loose ornaments and a selection of jewelry articles or semi-mounts styles, with the expectation that the customer will make a combined selection of a semi-mount along with an ornament to be mounted thereon.

A disadvantage of this system is that jewelry buyers are frequently reluctant to make a purchase of a loose ornament and semi-mount without viewing the ornament mounted on the semi-mount. The usual method of attaching the ornament on the jewelry article is to mount the ornament into a precious metal finding that is permanently soldered to the semi-mount into which a seat is cut on the interior of the finding for the ornament to set in. The finding is then bent over an edge of the ornament to securely hold the ornament in place. Both the cutting of the seat and the bending of the metal finding over the ornament is a highly skilled job. The metal finding once deformed or otherwise notched and the bent metal cannot be used again for the mounting of an ornament other than one of substantially the same size and shape as the ornament originally mounted.

There are numerous disadvantages to this conventional process of displaying an ornament. First, the jeweler is typically not sufficiently skilled to mount the ornament personally, and must send the ornament and the jewelry article to a shop having trained craftsmen. Additionally, the process can take from hours to days to be completed and returned. Such a process has a significant cost and risk to both the jeweler and to the jewelry buyer. The jeweler risks the financial loss of not making the sale of the ornament and the semi-mount after paying to have the ornament mounted, and the jewelry buyer risks not being satisfied with the finished piece of jewelry.

Therefore, there is a need for a system and method for temporarily displaying ornaments in a jewelry article.

SUMMARY OF THE INVENTION

The present invention provides a system and method for quickly and easily temporarily displaying an ornament in a jewelry article. A temporary ornament display apparatus comprises an ornament holder configured to temporarily hold an ornament and a jewelry article attachment configured to temporarily couple the ornament holder to the jewelry article. The temporary ornament display apparatus allows a user to mount and remove the ornament in the jewelry article without the use of special tools (e.g., by hand) and without any special preparation of the jewelry article.

The exemplary ornament holder comprises at least two arms extending from a common base. Each arm extends upward and outward from the common base and ends in an arm head. The exemplary arm head comprises a lower lobe and an upper flange which combine to form a notch. The notch aids in maintaining the ornament in position within the ornament holder.

Various embodiments of the common base of the ornament holder are provided. The base may comprise a hole and/or cavity in the base which allows a cutlet of the ornament to extend therethrough. The cavity may be funnel-shaped in order to stabilize the ornament within the ornament holder. Alternatively, curved flanges may be coupled to the base to stabilize the ornament.

In further embodiments, the base comprises an attachment means to the jewelry article attachment. One exemplary attachment means is a cavity shaped and sized to receive an arbor of the jewelry article attachment. Another attachment means may comprise a peg extending from a bottom of the base and configured to be inserted into the jewelry attachment article.

The jewelry article attachment comprises several means for attaching the temporary ornament display apparatus to the jewelry article. At least two sets of spokes may be provided which grip prongs of the jewelry article. Alternatively, the spokes may be downwardly-curved spokes which grip a shank of the jewelry article or an adhesive material may be utilized to temporarily adhere the display apparatus to the jewelry article. In further embodiments, the jewelry article attachment may comprise a peg configured to be inserted into a hole on the jewelry article. These exemplary pegs may be of various shapes, sizes, tapered, and/or threaded.

BRIEF DESCRIPTION OF THE DRAWINGS

FIG. 2 shows an ornament mounted in an exemplary embodiment of the temporary ornament display apparatus.

FIG. 3 shows the temporary ornament display apparatus coupled to a semi-mount or finding.

FIG. 4 shows an ornament mounted in the temporary ornament display apparatus, with the temporary ornament display apparatus itself coupled to a finding.

FIG. 5 is the top view of the temporary ornament display apparatus coupled to a finding and having an ornament mounted in the temporary ornament display apparatus.

FIGS. 6*a–d* show the temporary ornament display apparatus coupled to findings with differing numbers of prongs and displaying ornaments of varying shapes.

DESCRIPTION OF EXEMPLARY EMBODIMENTS

Figure 1C:
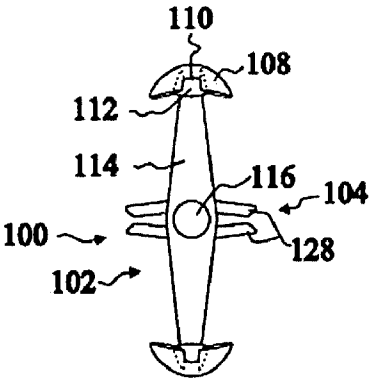
FIG. 1*c* is a top view of the exemplary temporary ornament display apparatus of the present invention.
Figure 1B:
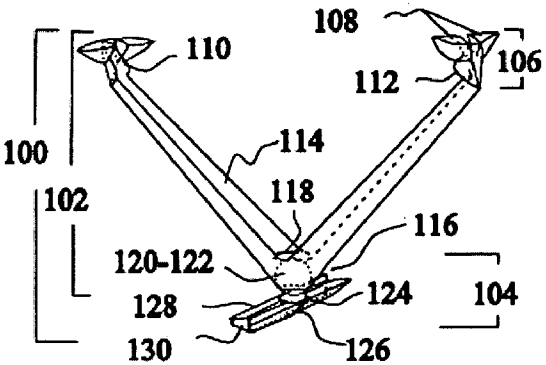
FIG. 1*a–b* show an exemplary embodiment of a temporary ornament display apparatus.
Figure 1A:
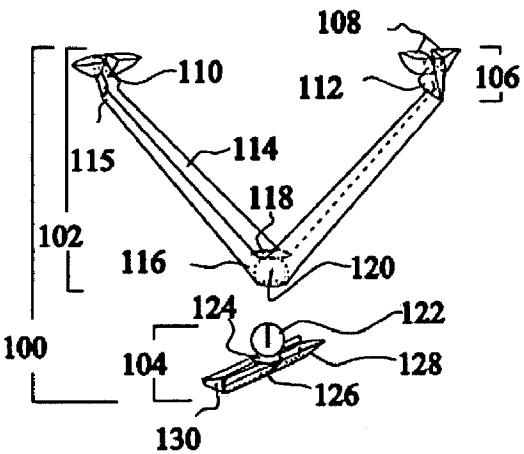

FIG. 1*a* shows an exemplary embodiment of a temporary ornament display apparatus 100 comprising an ornament holder 102 and a jewelry article attachment 104. The ornament holder 102 in turn comprises two arms 114 joined together at their bases or otherwise joined to a common base 116. These exemplary arms 114 extend upward from a same side of the common base 116, and diverge outwardly at identical angles from a center line or axis of the ornament holder 102 as a whole. On a free end 115 of each arm 114 are arm heads 106. The arm heads 106 comprise a lower lobe or lower projection 112 and an upper flange or upper projection 108 which join or intersect to define an ornament holding or gripping seat or notch 110.

In one embodiment of the common base 116, a socket or cavity 120 having a shape which matches or corresponds to an arbor 122 is provided. The socket 120 is positioned in a bottom of the common base 116 such that the arbor 122 may enter and fully engage the socket 120. The arbor 122 and socket 120 connection is known as a ball and socket joint, union, or connection.

The exemplary jewelry article attachment 104 comprises two sets of spokes 128, each set containing two spokes 128 joined together at a common hub or base 126. The sets of spokes 128 are located on opposite sides of the hub 126 or otherwise on two opposing sides of the hub 126 and extend outwardly on a same or shared horizontal axis in opposing directions from a vertical center axis of the jewelry article attachment 104 as a whole. The sets of spokes 128 on either side of the hub 126 are spaced apart on a converging angle from the hub 126, such that spacing between the pairs of the spokes 128 on either side of the hub 124 are widest at the hub 126 and converge or move closer together at distal ends 130 of either pair of spokes 128. The distal ends 130, in exemplary embodiments, are beveled at opposing or diverging angles, such that the distal ends 130 diverge outwardly at identical angles from the horizontal centerline or axis of the hub 126. Extending upward from the top of the hub 126 is a neck 124. Extending upward from the neck 124 is the arbor 122 which couples with the socket 120.

FIG. 1*b* shows an assembled elevated view of the temporary ornament display apparatus 100 with the arbor 122 fully engaged with the socket 120. Variations in the shape and size of the arbor 122 and its corresponding socket 120 are contemplated by the present invention as will be described infra.

FIG. 1*c* illustrates a top plan view of the temporary ornament display apparatus 100 in further detail. The ornament holder comprises two arms 114 that are joined together at the common base 116. The lower lobe or projection 112 joins or intersects the upper lobe or projection 108 to form the ornament holding or gripping seat or notch 110. The jewelry article attachment 104 has two pairs of spokes 128, and can be attached to the ornament holder apparatus 102 at the base 116.

Figure 1G:
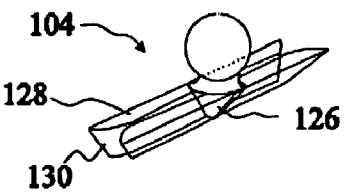
FIGS. 1*e–g* are alternative embodiments of the apparatus with different distal end surface configurations.
Figure 1F:
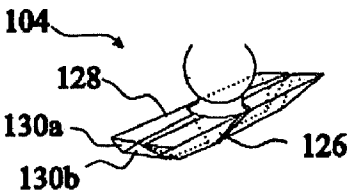
Figure 1E:
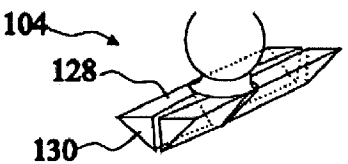
Figure 1D:
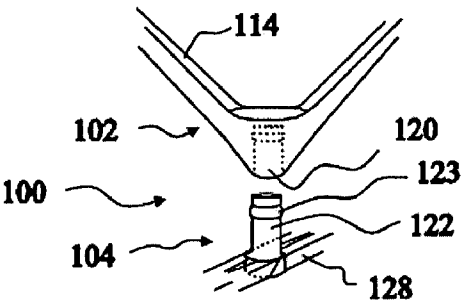
FIG. 1*d* is an embodiment of the temporary ornament display apparatus designed to allow the arms to be rotated in relation to the spokes.

FIG. 1*d* shows one variation of the arbor 122 and socket 120 connection, with the arbor 122 having a flange 123 located near the top of the arbor 122, and the socket 120 having a corresponding shape to receive the arbor 122. When the temporary ornament display apparatus 100 is assembled as in FIG. 1*b*, the flange 123 on the arbor 122 will fully engage with the socket 120 and act to hold the engaged arbor 122 in position.

FIG. 1*e* shows another embodiment of the jewelry article attachment 104. In this embodiment, surfaces of the distal ends 130 of the spokes 128 are formed at a 90-degree angle to a horizontal axis of the spoke 128.

FIG. 1*f* shows another embodiment of the jewelry article attachment 104 with the spokes 128 having two distal end surfaces 130. A first surface 130*a* is positioned sharing a common border with a top distal edge of the spoke 128 and forming a triangle-shaped surface on an axis 90-degrees to the horizontal axis of the spoke 128. A second triangle-shaped surface 130*b* shares a lower inside border of the first triangle-shaped surface and is positioned on an oblique angle. The second triangle-shaped surface 130*b* is located adjacent to the space between the pairs of spokes 128 and generally extends towards the hub 126 and terminates at the bottom edge of the spoke 128, creating a wider space between the spokes 128 at the distal end 130 than the space otherwise from the hub 126 extending to the distal end 130 of each pair of spokes 128.

FIG. 1*g* shows another embodiment of the jewelry attachment component 104 with the distal ends 130 of the spokes 128 having rounded surfaces that curve about distal outside edges and generally extending toward the hub 126. The curvature terminates generally close to the hub 126 creating a wider space between the spokes 128 at the distal end 130 than the space between the hub 126 and the distal end 130 of each pair of spokes 128. It should be noted that the beveled distal ends 130 described in FIGS. 1*a*, 1*f*, and 1*g* create a small "opening" which guides the prongs of the jewelry article and allow the prongs to easily access the cavity or space between the spokes 128.

The design of the exemplary embodiments of FIG. 1 (more specifically, the arbor-spoke design) allows rotation of the arms 114 in relation to the spokes 128. Thus, an ornament (not shown) coupled within the temporary ornament display apparatus 100 may be slightly positioned via the rotation. The slight positioning may be useful, for example, when the ornament 202 is of an asymmetric shape. Another important reason for the rotation of the arms 114 is so that the finding prongs do not contact or interfere with the arms 114, allowing the apparatus 100 to be fully lowered into a finding.

Referring now to FIG. 2, the exemplary temporary ornament display apparatus 100 is shown displaying an ornament 202. Interior surfaces of an ornament seat 110 relative to an arm head 106 overall form a notch or space 110 that will engage or contact a crown on top facets 210 of the ornament 202. In alternative embodiments, a pavilion or bottom facets 212 of the ornament 202 may be temporarily engaged in the space 110. A girdle 214 of the ornament 202 extends into the ornament seat 110 to a depth that the engagement between the interior surfaces of the ornament seat 110 and the combination of the surfaces of the crown 210, the pavilion 212, and the girdle 214 of the ornament 202 allows when coming into contact with, or engaging surfaces of, the temporary ornament display apparatus 100.

FIG. 3 illustrates a fragmented elevated view of an exemplary solitaire ring shank 302 with a finding 304 permanently soldered or attached thereto resulting in a solitaire ring semi-mount 306 having the temporary ornament display apparatus 100 coupled to the finding 304 of the solitaire semi-mount 306. In exemplary embodiments, the finding 304 is metal such as gold. Further as shown in the embodiment of FIG. 3, the finding 304 is a four-prong finding, although any number-prong finding may be utilized with the present invention.

The temporary ornament display apparatus 100 is temporarily held in place by tension created by a flexing or pinching pressure of the pairs of spokes 128 against prongs 308 of the finding 304. Such positioning causes the divergence or moving apart of the spokes 128. The spokes 128 then flex back or attempt to return to their natural relaxed position, thus applying pressure against the prongs 308 of the finding 304. The temporary ornament display apparatus 100 is properly positioned when at a lowest point within an interior of the finding 304 so that bottoms of the spokes 128 approach or contact an interior floor on a base 312 of the finding 304. Alternatively, the temporary ornament display apparatus 100 is otherwise fully engaged on the finding 304 when the temporary ornament display apparatus 100 is lowered or seated to the lowest point within the finding 304, so that contact between the temporary ornament display apparatus 100 and the finding 304 prevents further movement.

FIG. 4 shows a fragmented elevated view of the solitaire semi-mount 306 of FIG. 3 with the temporary ornament display apparatus 100 coupled thereto. Further, an ornament 202 is coupled within the temporary display apparatus 100 such that the ornament 202 may be viewed within the solitaire semi-mount 306 without the need for supporting the ornament 202 with other specialized tools. As a result, the ornament 202 may be manipulated without falling away from the solitaire semi-mount 306.

Referring now to FIG. 5, a top plan view of the solitaire semi-mount 306 with the ornament 202 of FIG. 4 is shown. The ornament 202 is displayed within the temporary display apparatus 100 such that a potential buyer may view the ornament 202 and the solitaire semi-mount 306 together without interference from specialized tools and without having to permanently mount the ornament 202. The spokes 128 of the temporary ornament display apparatus 100 are aligned and fully engaged on two of the prongs 308 of the finding 304. The arbor 122 and socket 120 connection 502 of the temporary ornament display apparatus 100 has been rotated to align and position the arms 114 between the prongs 308 of the finding 304.

FIGS. 6*a–d* illustrate alternate embodiments displaying various ornament 202 shapes utilized on the present invention. As shown, a single apparatus 100 may be utilized on various semi-mounts 206 having any number of prongs and varying prong configurations. FIG. 6*a* shows a solitaire ring semi-mount 306 with a 6-prong finding 304 configuration designed for a round-shaped ornament 202 to be disposed thereon. FIG. 6*b* illustrates a plan view of a solitaire ring semi-mount 306 with a four-prong finding 304 configuration for a rectangle-shaped ornament to be disposed thereon, while FIG. 6*c* shows a solitaire ring semi-mount 306 with a six-prong finding 304 configuration for a marquise-shape ornament. Finally, FIG. 6*d* shows a solitaire ring semi-mount 306 with a five-prong finding 304 configuration for displaying of a heart-shape ornament. It should be noted that any shape and/or size ornament 202 may be displayed using the present invention. Exemplary ornaments may comprise gemstones, pearls, and any other item which may be mounted in a jewelry article such as a semi-mount 306.

Figure 7:
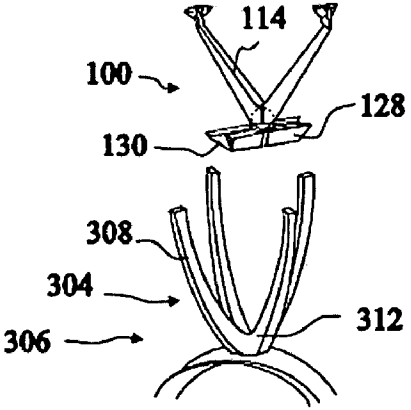
FIGS. 7–13 demonstrate a method of coupling the temporary ornament display apparatus to the finding and mounting the ornament in the temporary ornament display apparatus.

FIGS. 7–13 demonstrate an exemplary method of displaying an ornament 202 on a solitaire ring semi-mount 306 equipped with a four-prong metal finding 304. Referring to FIG. 7, the temporary ornament display apparatus 100 is shown apart from the semi-mount 306. The semi-mount 306 is held in a generally upright position with the prongs 308 pointing upward. The temporary ornament display apparatus 100 is held approximately over a center of the finding 308 with the arms 114 pointing upward, aligning the spoke distal ends 130 with two prongs 308 of the finding 304 and aligning the arms 114 to be positioned between the prongs 308 of the finding 304.

Figure 8:
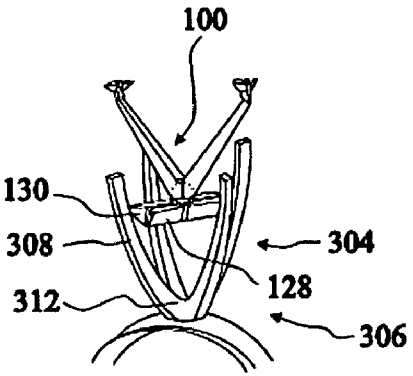

FIG. 8 shows the temporary ornament display apparatus 100 partially lowered into the center of the finding 304, while maintaining the alignment of the spoke 128 distal ends 130 with the prongs 308. As the temporary ornament display apparatus 100 is lowered, the prongs 308 engage the space between the distal ends 130 of the spokes 128.

Figure 9:
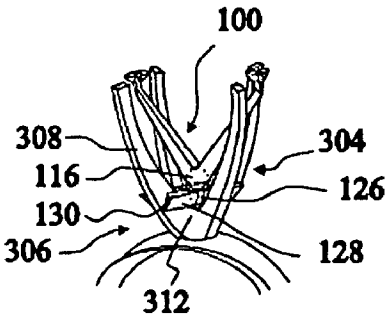

FIG. 9 shows the temporary ornament display apparatus 100 fully lowered into the finding 304. As the temporary ornament display apparatus 100 is lowered into the finding 304, the wider angled (beveled) opening on the distal ends 130 of the spokes 128 guide and keep the prongs 308 aligned in a space between the pairs of spokes 128. As the temporary ornament display apparatus 100 is further lowered, the pairs of spokes 128 are flexed open by the greater width of the prongs 308 entering the narrower space between the pair of spokes 128. As the temporary ornament display apparatus 100 continues to be further lowered, the prongs 308 are engaged further into the space between the pairs of spokes 128 of the temporary ornament display apparatus 100 until the temporary ornament display apparatus 100 is seated near or at the bottom or base 312 of the finding. Once the temporary ornament display apparatus 100 is seated in the finding 304, the temporary ornament display apparatus 100 is held in position predominantly by the pressure or tension exerted by the spokes 128 straddling and flexing back toward their original relaxed position against the prongs 308.

Figure 10:
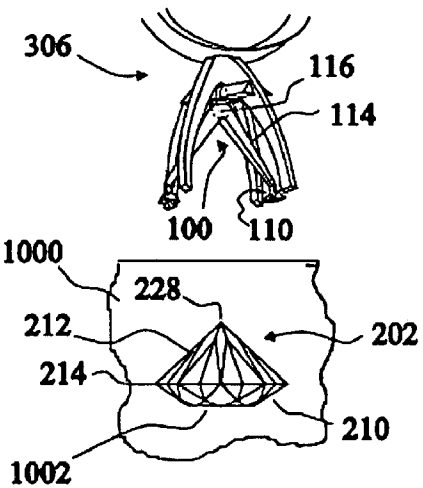

FIGS. 10–13 illustrate an exemplary method for mounting an ornament 202 on the semi-mount 306 of FIG. 9. Referring to FIG. 10, the ornament 202 is held in a stabilized position, for example, by placing it on a flat stable surface 1000. In this position, a table or top of a crown 1002 rests on the surface 1000 and the pavilion 212 points upwards. The semi-mount 306 with the temporary ornament display apparatus 100 coupled thereto, is inverted or turned upside down, and the temporary ornament display apparatus 100 is positioned directly over the ornament 202.

Figure 11:
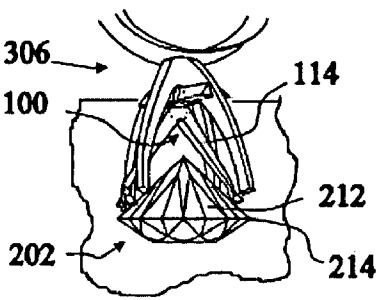

FIG. 11 shows the semi-mount 306 lowered downward over the pavilion 212 of the ornament 202. As the temporary ornament display apparatus 100 engages the ornament 202 and continues to be lowered, the ornament pavilion 212 flexes the arms 114 outward toward the gem girdle 214.

Figure 12:
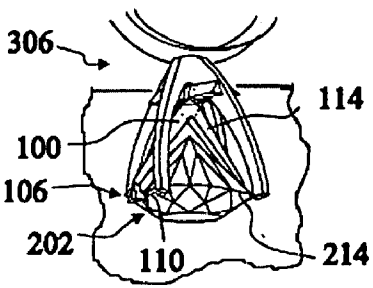

FIG. 12 shows the semi-mount 306 with the ornament 202 engaged in the temporary ornament display apparatus 100. As the temporary ornament display apparatus 100 continues to be brought downward, a portion of the girdle 214 of the ornament 202 is positioned in each of the ornament seats 110. The arms 114 are resilient enough such that, when this occurs, the arms 114 move back toward their original position (i.e., the arms 114 are resilient such that they move to regain their original position), and the ornament 202 is held in position in the ornament seat 110 predominantly by the resulting tension or pressure of the flex of the arms 114 trying to regain their original position. Additionally, arm heads 106 may further aid in retaining the ornament 202 in position within the temporary ornament display apparatus 100. Therefore, the temporary ornament display apparatus 100 maintains the ornament 202 without any need to bend, solder, or otherwise alter the semi-mount 306.

Figure 13:
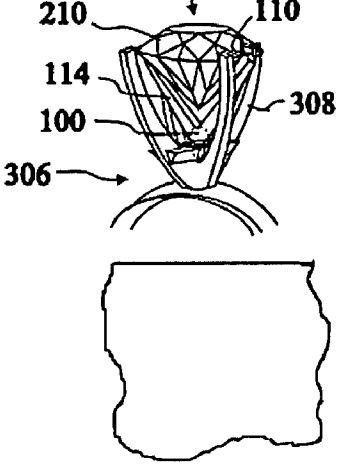

FIG. 13 shows the solitaire semi-mount 306 with an ornament 202 displayed therein in an upright position. The solitaire semi-mount 306 may now be tilted without separating the ornament 202 from the temporary ornament display apparatus 100 or the temporary ornament display apparatus 100 from the solitaire semi-mount 306.

The ornament 202 may be released from the temporary ornament display apparatus 100 by pushing against the arm head 106 with fingers and spreading the arms 114 apart until the ornament 202 is free. Generally, the semi-mount 306, the ornament 202, and the temporary ornament display apparatus 100 may be unassembled (e.g., by hand) in a reverse order without the use of special tools or special training. Further, the combination may be reassembled with a new ornament 202 of a different size or shape using a temporary ornament display apparatus 100 that corresponds to the size and shape of the new ornament 202.

The present invention may be utilized with semi-mounts with various sized findings. For example, FIG. 14 shows a solitaire ring semi-mount 306 with a ⅓-carat finding 304 and having the temporary ornament display apparatus 100 coupled thereto with a ¾-carat ornament 202 displayed therein.

Figure 14:
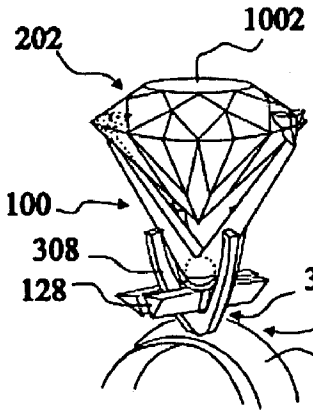
FIGS. 14–18 show variations in size of ornaments with the same size of temporary ornament display apparatus displayed in different sizes of finding.
Figure 15:
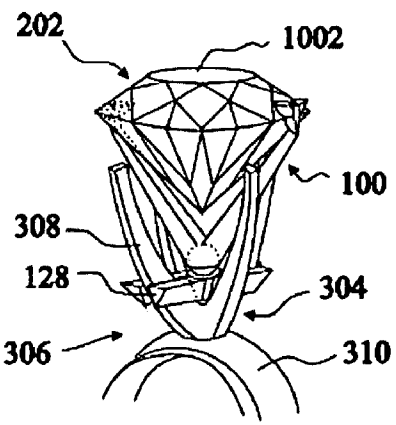

FIG. 15 shows a solitaire ring semi-mount 306 with a larger ½-carat finding 304 and the same ¾-carat ornament 202 as FIG. 14 displayed therein. The longer prongs 308 of the larger ½-carat finding 304 extend higher than the prongs 308 of the ⅓-carat finding 302 illustrated in FIG. 14.

Figure 16:
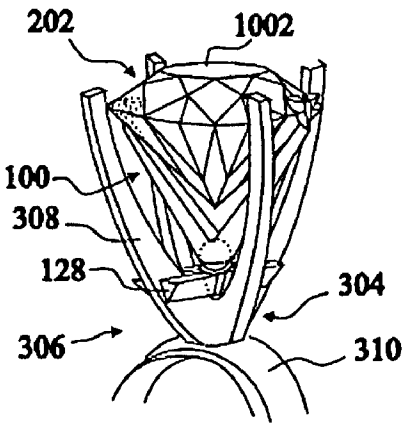

As a further example, FIG. 16 shows a solitaire ring semi-mount 306 with a larger one-carat finding 304 installed thereon and having the same temporary ornament display apparatus 100 and the same ¾-carat ornament 202 displayed therein. The longer prongs 308 of the larger one-carat finding 304 extend higher, relative to a table 1002 of the ornament 202, than the shorter prongs 308 of the ⅓- and ½-carat finding 304 illustrated in FIGS. 14–15.

As shown, the temporary ornament display apparatus 100 corresponding to a particular ornament 202 will couple and sit on a variety of finding 304 sizes and shapes. The spokes 128 of the temporary ornament display apparatus 100 will engage and attach to various prong 308 sizes. The temporary ornament display apparatus 100 will equally attach to findings 304 having various configurations which provide engagement of the prong 308 between the spokes 128 of the temporary ornament display apparatus 100.

Figure 17:
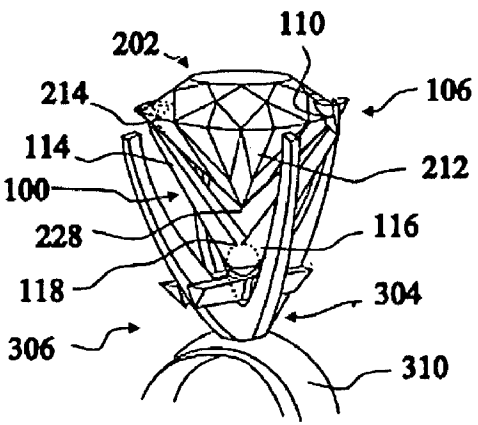
Figure 18:
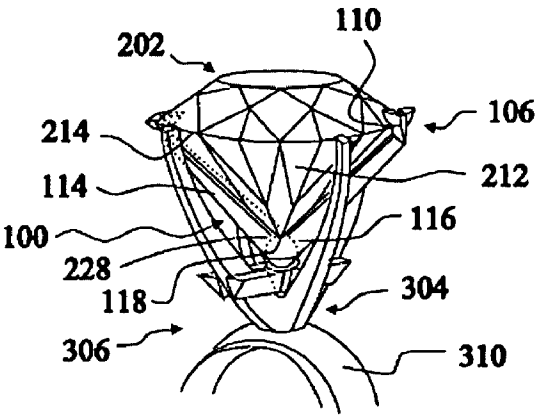

Referring now to FIGS. 17 and 18, different sized ornaments 202 may be displayed on the same semi-mount 306. For example, FIG. 17 shows a solitaire semi-mount 306 with a one-carat finding 304 and having a ¾-carat ornament 202 displayed therein. FIG. 18 shows the same solitaire semi-mount 306 with the one-carat finding 304 and with the same temporary ornament display apparatus 100 as in FIG. 17, but with a larger one-carat ornament 202 displayed therein. With the larger one-carat ornament 202, the arms 114 are spread further apart from the center axis of the temporary ornament display apparatus 100 as a whole than on the smaller ¾-carat ornament 202 illustrated in FIG. 17. Furthermore, it can be seen that the pavilion 212 of the larger one-carat ornament 202 extends deeper between the arms 114 of the temporary ornament display apparatus 100 Thus, the culet 228 is closer to the base floor 118 of the temporary ornament display apparatus 100 than the smaller ¾-carat ornament 202.

Therefore, after selecting the temporary ornament display apparatus 100 corresponding to an ornament 202, the arms 114 of the same temporary ornament display apparatus 100 may spread apart to capture various other size ornaments 202. The smallest ornament 202 size able to be captured by the selected temporary ornament display apparatus 100 will be somewhat wider than a relaxed distance or width between the ornament seats 110 of the temporary ornament display apparatus 100. Thus, when the ornament 202 is properly seated in the temporary ornament display apparatus 100, the arm 114 will attempt to move back to regain their original position and, along with the arm head 106, hold the ornament 202 in position. The largest ornament 202 that may be displayed in the same temporary ornament display apparatus 100 will have dimensions that allow the culet 228 to fit in the available space within the confines of interior walls of the temporary ornament display apparatus 100. Thus, the pavilion 212 may be engaged into the space between the arms 114 to the extent that contact between the temporary ornament display apparatus 100 and the ornament 202 permits.

Figure 36:
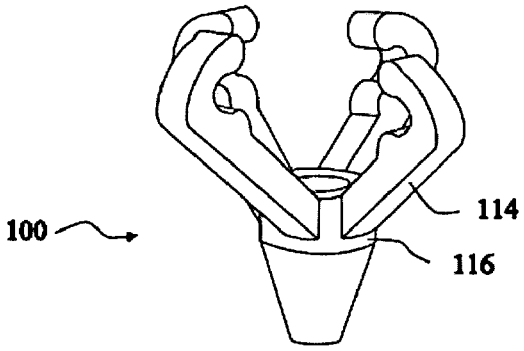
FIG. 36 shows an exemplary four-arm embodiment of the present invention.

The present invention contemplates various embodiments of the temporary ornament display apparatus 100. In alternative embodiments, the temporary ornament display apparatus 100 may comprise, for example, different spoke configurations, number of arms, and number of spokes. For example, if the jewelry article attachment 104 comprises a four-spoke set configuration, then these spoke sets may be positioned 90-degrees apart. As a further example, the ornament holder 102 may comprise four arms as shown in FIG. 36.

Figure 19:
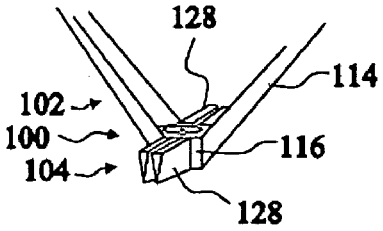
FIGS. 19–21 are variations showing one-piece embodiments of the temporary ornament display apparatus.

FIG. 19 shows another embodiment of the temporary ornament display apparatus 100 having a one-piece configuration (i.e., combination of the ornament holder 102 and the jewelry article attachment 104) with the common arm base 116 having two pairs of fixed position spokes 128 extending therefrom. Spokes 128 in a fixed position on the common arm base 116 engage or attach to the prongs 308 of a finding 304 in the same manner as the embodiment illustrated in FIGS. 7–13. This one-piece temporary ornament display apparatus 100 with fixed position spokes 128 will correspond or align to specific finding 304 and prong 308 configurations.

Figure 20:
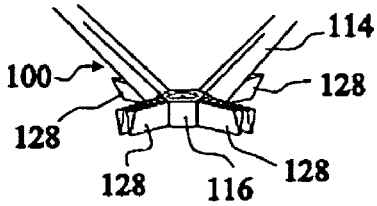

Various other configurations of one-piece (fixed-positioned spokes) temporary ornament display apparatuses 100 may be designed to align with various other finding 304 and prong 308 configurations. For example, FIG. 20 shows one embodiment of the one-piece temporary ornament display apparatus 100 having the common arm base 116 and four pairs of fixed-positioned spokes 128 extending therefrom. Spokes 128 in the fixed position will engage up to four prongs 308 of the finding 304 in a manner similar to that of the FIGS. 7–13 embodiment. This one-piece temporary ornament display apparatus with fixed position spokes 128 will correspond to specific finding 304 and prong 308 configurations. However, various other configurations may be designed to align with various other finding 304 and prong 308 configurations (e.g., an embodiment for six-prong engagement).

Figure 21:
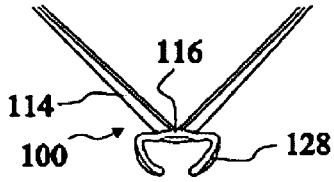

FIG. 21 shows another embodiment of a jewelry article attachment 104 of the temporary ornament display apparatus 100. This embodiment comprises two downward-extending curved spokes 128. Downward-extending spokes 128 will properly align between the prongs 308 of the finding 304 and engage the common base 312 of the finding 304 or some other suitable location on the semi-mount 306 (not shown). Various other configurations of the downward-extending spokes 128 may be designed and produced to align with various other finding 304 or semi-mount 306 configurations.

Figure 22A:
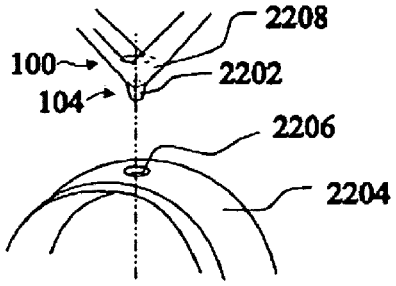
FIGS. 22*a*–*c* are variations showing peg component embodiments of the temporary ornament display apparatus.

FIG. 22*a* shows another embodiment of a jewelry article attachment 104 of a temporary ornament display apparatus 100 having a square-tapered peg 2202 extending downward from a bottom of the temporary ornament display apparatus 100 common arm base 2208. Also shown is a ring shank 2204 having a hole or cavity 2206. The hole 2206 in the shank 2204 is designed to receive the peg 2202 that extends from the bottom of the display apparatus 100. In some embodiments, the peg 2202 may be soldered in place to prepare the semi-mount 306 for permanently mounting an ornament 202 in the ring semi-mount 306.

The temporary ornament display apparatus peg 2202 is coupled to the shank 2204 by inserting the peg 2202 into the hole 2206 on the shank 2204 with the use of downward applied pressure and, if needed, a twisting motion. As the square-tapered peg 2202 is inserted into the hole 2206 on the shank 2204, progressive tension is created between the peg 2202 and walls of the hole 2206 in the shank 2204. The peg 2202 is then held in place predominantly by the tension created between the peg 2202 and the hole 2206, thereby temporarily coupling the temporary ornament display apparatus 100 to the ring shank 2204. An ornament 202 (not shown) may then be displayed in the temporary ornament display apparatus 100 in the same manner as previously described. Generally, the ring shank 2204, the ornament 202, and the temporary ornament display apparatus 100 may be unassembled in a reverse order without the use of special tools or special training. Furthermore, the combination may be reassembled with a new ornament 202 of a different size or shape using a temporary ornament display apparatus 100 that corresponds to the size and shape of the new ornament 202.

Figure 22B:
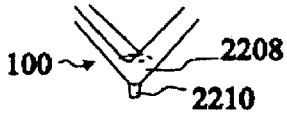

FIG. 22*b* shows an exemplary embodiment of a temporary ornament display apparatus 100 having a round tapered peg 2210 extending downward from the bottom of the common arm base 2208. The peg 2210 is attached to the shank 2204 (e.g., by hand) by inserting the peg 2210 into the hole 2206 (FIG. 22*a*) on the shank 2204 with the use of downward applied pressure and/or a combination of downward applied pressure and a twisting motion. Because the diameter of a top portion of the peg 2210 is slightly larger than the hole 2206, progressive tension is created between the peg 2210 and walls of the hole 2206 in the shank 2204 when the peg 2210 is inserted in the hole 2206. The peg 2210 is then held in position predominantly by tension created between the peg 2210 and the walls of the hole 2206, thereby temporarily attaching the temporary ornament display apparatus 100 to the ring shank 2204. An ornament 202 (not shown) may then be displayed in the temporary ornament display apparatus 100 as previously described.

Figure 22C:
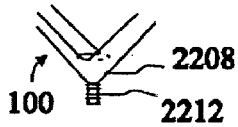

FIG. 22*c* shows another exemplary embodiment of a temporary ornament display apparatus 100 having a round peg 2212 extending downward from the bottom of the common arm base 2208. The exemplary peg 2212 is threaded and is attached to the shank 2204 (FIG. 22*a*)(e.g., by hand) by inserting the peg 2212 into the hole 2206 on the shank 310 with a downward pressure and a twisting motion. As the round peg 2212 is inserted into the hole 2206, progressive tension is created between the threads of the peg 2212 and the walls of the hole 2206 thus holding the temporary ornament display apparatus 100 in place by the tension. An ornament 202 (not shown) may then be displayed in the temporary ornament display apparatus 100. As can be seen, a peg of any size or shape may be utilized in the present invention.

Figure 23A:
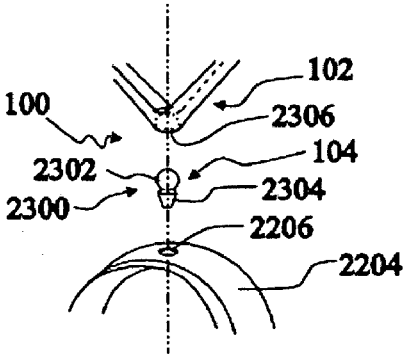
FIGS. 23*a*–*d* are further embodiments showing different attachment components.

Referring now to FIG. 23*a*, an alternative (two-piece) embodiment of a temporary ornament display apparatus 100 is shown. In this embodiment, an arbor attachment 2300 of the jewelry article attachment 104 comprises a round tapered peg 2304 extending downward from a bottom of an arbor 2302. Also shown is the ring shank 2204 having a hole 2206. The hole 2206 is designed to receive the peg 2304. The arbor peg 2304 is coupled to the shank 2204 by inserting the peg 2304 into the hole 2206 on the shank 2204 and applying a downward pressure and, if needed, a twisting motion. As the peg 2304 is inserted into the hole 2206, progressive tension is created between the peg 2304 and walls of the hole 2206. The peg 2304 is then held in place predominantly by the tension created between the peg 2304 and the hole 2206, thereby temporarily coupling the arbor 2302 to the ring shank 2204. An ornament holder 102 may then be coupled to the arbor 2302 via a socket 2306 attachment to the arbor 2302. An ornament 202 (not shown) may then be displayed in the ornament holder 102.

Figure 23B:
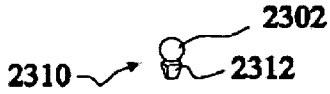

FIG. 23*b* is a further exemplary embodiment of a separable arbor attachment 2310. The exemplary arbor attachment 2310 comprises a square tapered peg 2312 extending downward from a bottom of the arbor 2302. The peg 2312 may be coupled to the shank 2204 (FIG. 23*a*) by inserting the peg 2312 into the hole 2206 (FIG. 23*a*)on the shank 2204 (e.g., by hand) with a downward pressure and, if needed, a twisting motion. As the square tapered peg 2312 is inserted into the hole 2206, progressive tension is created between the peg 2312 and the walls of the hole 2206. The peg 2312 is then held in position predominantly by the tension created between the peg 2312 and the hole 2206, thus coupling the arbor attachment 2310 to the ring shank 2204. An ornament holder 102 may then be coupled to the arbor 2302, and an ornament 202 (not shown) may be displayed in the temporary ornament display apparatus 100.

Figure 23C:
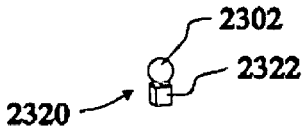

FIG. 23*c* is another alternative embodiment of a separable arbor attachment 2320. The exemplary arbor attachment 2320 comprises a square peg 2322 extending downward from a bottom of the arbor 2302. The peg 2322 may be coupled to a shank 2204 (FIG. 23*a*) by inserting the peg 2322 into a hole 2206 (FIG. 23*a*) on the shank 2204 using pressure or a combination of pressure and a twisting motion. The peg 2322 is then held in place predominantly by tension created between the peg 2322 and the hole 2206 of the ring shank 2204.

Figure 23D:
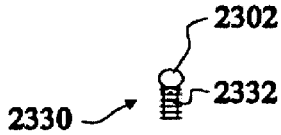

FIG. 23*d* is yet another embodiment of a separable arbor attachment 2330 comprising a round threaded peg 2332 extending downward from a bottom of the arbor 2302. The peg 2332 may be coupled to the shank 2204 (FIG. 23*a*) by inserting the peg 2232 into the hole 2206 (FIG. 23*a*) on the shank 2204. Progressive tension created between the inserted peg 2332 and the walls of the hole 2206 in the shank 2204 hold the peg 2332 in place, thereby temporarily attaching the peg 2332 to the ring shank 2204.

In the embodiments of FIGS. 23*a–d,* the various pegs 2304, 2312, 2322, and 2332 may be inserted into the hole 2206 prior to, or after, the ornament holder 102 is coupled to the arbor 2302. Furthermore, because these embodiments comprise a separable jewelry article attachment 104) arbor attachment, ornament holders may be exchanged and/or replaced to accommodate different ornaments 202, or to accommodate different sized holes.

Figure 24A:
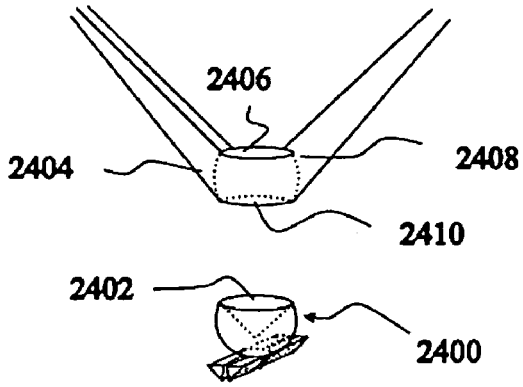
FIGS. 24*a*–27 are alternative embodiments of the temporary ornament display apparatus with arbor and socket joints designed to allow deeper ornaments to be displayed by the temporary ornament display apparatus.

Referring now to FIG. 24*a,* an alternative arbor 2400 is shown. In this embodiment, the arbor 2400 comprises a cone-shaped cavity 2402 positioned on a top portion of the arbor 2400. Correspondingly, a common arm base 2404 comprises an opening 2406 through a base floor 2408 into a socket cavity 2410 that corresponds with the cone-shaped cavity 2402 in the arbor 2400. When the temporary ornament display apparatus 100 is assembled, the arbor 2400 will fully engage the socket cavity 2410.

Figure 24B:
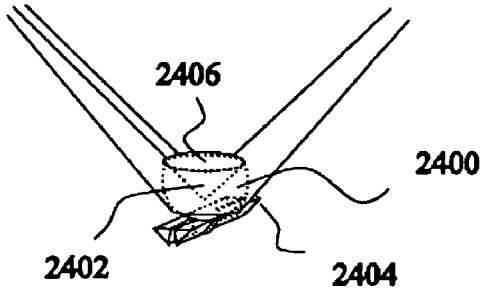

FIG. 24*b* shows an assembled version of FIG. 24*a* with the cone-shaped cavity 2402 coupled to the socket cavity 2410 such that the opening 2406 in the common arm base 2404 corresponds to the cone-shaped cavity 2402. The cone-shaped cavity 2402 in the arbor 2400 allows faceted ornaments 202 (not shown) having a range of depths to be displayed in the temporary ornament display apparatus 100. For example, a culet 228 or a bottom tip of a faceted ornament 202 (not shown) having a deeper pavilion 212 may be positioned within the cone-shaped cavity 2402 in the arbor 2400 through the corresponding opening 2406 in the base floor 2404.

Figure 25A:
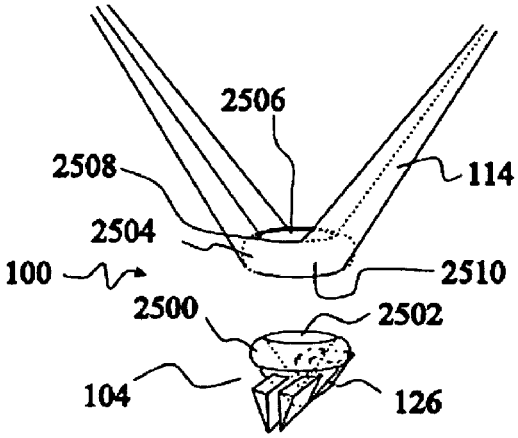

FIG. 25*a* shows another embodiment of the temporary ornament display apparatus 100. In this embodiment, an arbor 2500 comprises a cone-shaped design with a cone-shaped cavity 2502 located in a top of the arbor 2500. Correspondingly, a common arm base 2504 comprises an opening 2506 that extends through a base floor 2508 and into a socket cavity 2510. The socket cavity 2510 corresponds with the cone-shaped cavity 2502 in the arbor 2500 such that when the arbor 2500 is fully engaged in the socket cavity 2510, the temporary ornament display apparatus is assembled.

Figure 25B:
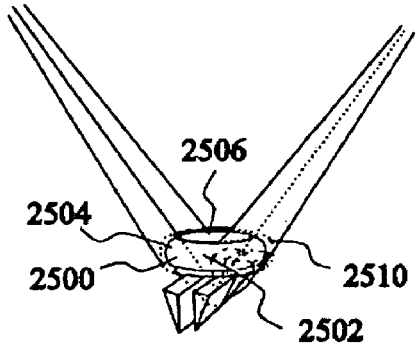

Referring now to FIG. 25*b,* the embodiment of FIG. 25*a* is shown fully assembled. Thus, the arbor 2500 is coupled to the socket cavity 2510 such that the opening 2506 in the common arm base 2504 corresponds to the cone-shaped cavity 2502 in the arbor 2500. The cone-shaped cavity 2502 in the arbor 2500 allows a range of faceted ornaments 202 (not shown) to be displayed in the temporary ornament display apparatus 100. For example, a culet 228 (not shown) or a bottom tip of a faceted ornament 202 having a deeper pavilion 212 may be positioned within the cone-shaped cavity 2502 in the arbor 2500 through the corresponding opening 2506 and socket cavity 2510.

Figure 26:
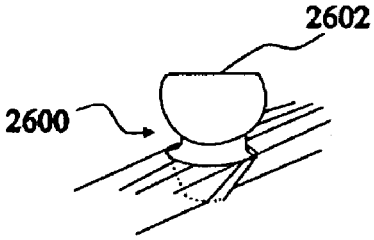

FIG. 26 shows yet another alternative embodiment of an arbor 2600 of a two-piece temporary ornament display apparatus 100. This exemplary arbor 2600 is truncated on a top portion. When the arbor 2600 is fully engaged in a corresponding socket (e.g., similar to that of FIG. 23*a*), a space is created between the truncated top of the arbor 2600 and a base floor (not shown). Such space in the socket allows a range of faceted ornaments 202 (not shown) to be displayed in the temporary ornament display apparatus 100 by allowing the culet 228 of the faceted ornament 202 having a deeper pavilion 212 to be positioned within the space through a coordinated cavity or hole in the base floor.

Figure 27:
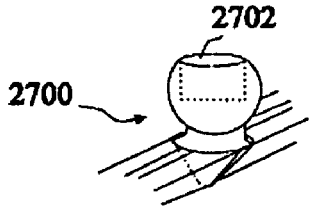

FIG. 27 shows an alternative embodiment of an arbor 2700 similar to that of FIG. 26 but having a cavity 2702 therein. In this exemplary embodiment, the cavity 2702 is tubular shaped, although any shape and size may be utilized (e.g., cone, sphere, etc.). When the arbor 2700 is fully engaged in a corresponding socket, the tubular-shaped cavity 2702 in the arbor 2700 may display ornaments 202 (not shown) of various depths by allowing a culet 228 of the ornament 202 having a deeper pavilion 212 to be positioned within the tubular-shaped cavity 2702 in the arbor 2700 through a coordinated hole in a base floor.

Figure 30:
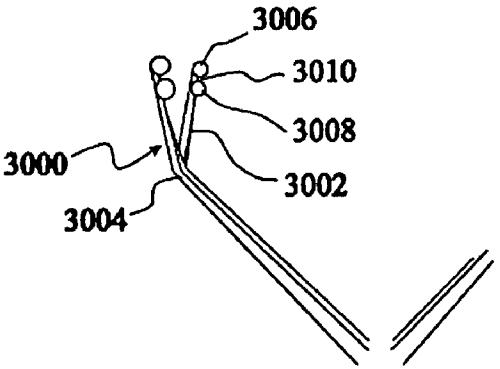
FIGS. 28–30 are embodiments of the temporary ornament display apparatus showing different arm head configurations, according to the present invention.
Figure 29:
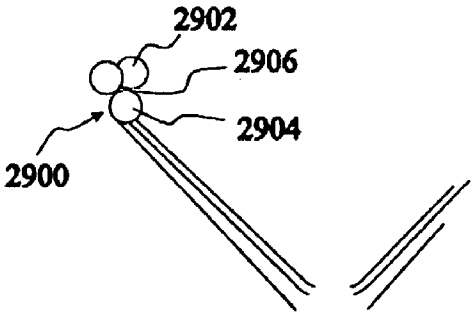
Figure 28:
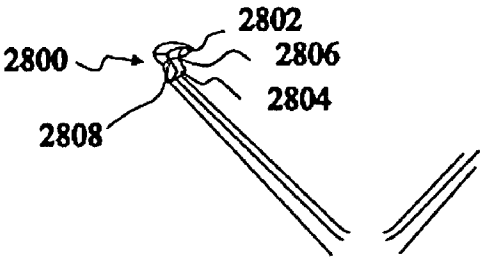

Referring now to FIG. 28–30, various embodiments of arm heads which may be utilized in the present invention are provided. FIG. 28 illustrates an arm head 2800 comprising a solid one-piece shape or form. This exemplary arm head 2800 comprises an arm head flange 2802, an arm head lobe 2804, and a notch 2806 which in combination form an arm head ornament seat 2808.

FIG. 29 illustrates an embodiment of an arm head 2900 comprising two side-by-side orbs (which form a flange 2902) and an arm head lobe 2904. The arm head lobe 2904 may comprise a single orb positioned below the flange 2902 and between the two arm head flange orbs. The ornament seat 2906 is formed in a space created between the flange 2902 and the arm head lobe 2904.

FIG. 30 shows a further embodiment of an arm head 3000. The exemplary arm head 3000 comprises two smaller arms 3002 diverging from a distal end of an arm 3004. Each smaller arm 3002 comprises a single orb forming an arm head flange 3006 and a single orb forming an arm head lobe 3008 coupled thereto. The arm head lobe 3008 is generally positioned directly below the arm head flange orb 3006, thus creating an ornament seat 3010 on each smaller arm 3002.

FIGS. 28–30 are exemplary embodiments and illustrate that the arm heads may comprise various shapes, sizes, and configurations.

Figure 33:
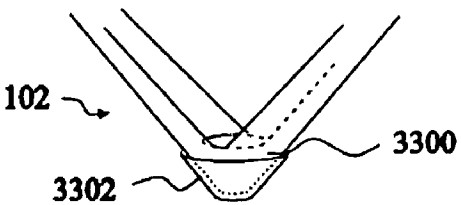
FIG. 33 is an embodiment of the present invention using adhesive to couple the embodiment to a finding.
Figure 32:
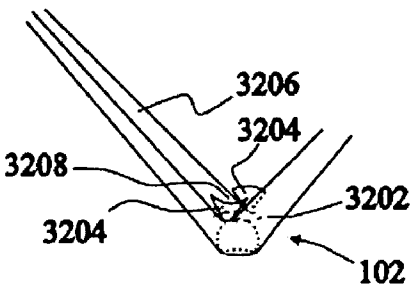
FIGS. 31–32 are embodiments of the temporary ornament display apparatus designed to allow a culet of an ornament to be seated into the temporary ornament display apparatus in order to stabilize the ornament in position.
Figure 31:
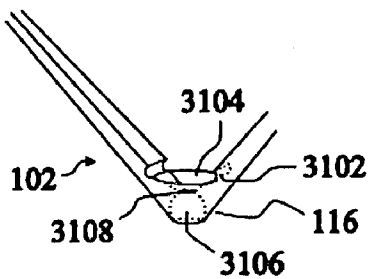

Referring now to FIGS. 31–33, various embodiments of ornament holders 102 are shown. FIG. 31 shows an embodiment of the ornament holder 102 comprising a base floor 3102 with a circular funnel-shape cavity 3104 formed therein. The funnel-shape cavity 3104 may further comprise an opening 3108 extending through the base floor 3102 and into a socket cavity 3106. When an ornament 202 (not shown) is positioned in the ornament holder 102, a culet 228 may extend into the cavity 3104 and may even extend through the opening 3108 into the socket cavity 3106. The cavity 3106 may limit movement of the culet 228, thus stabilizing the ornament 202.

FIG. 32 shows an embodiment of an ornament holder 102 comprising a common base 3202 having two flanges 3204. One flange 3204 is positioned on either side of, and between, arms 3206. The flanges 3204 extend at an upward angle between the arms 3206 creating a circular cavity 3208 between the arms 3206 and the flanges 3204. When a girdle 224 of an ornament 202 (not shown) is seated in an ornament seat 110, a culet 228 may extend into the cavity 3208. The cavity 3208 may limit movement of the culet 228, and thereby stabilize the ornament 202.

FIG. 33 shows an embodiment of the ornament holder 102 as a one-piece or one-component embodiment. In this embodiment, an exterior surface of a common arm base 3300 comprises a double-sided adhesive material 3302 disposed thereon. An inner surface of the adhesive material

3302 is applied to the common base 3300 exterior surface and the outer surface of the adhesive material is exposed. The outer surface of the adhesive material 3302 adheres, sticks, or attaches to an article of jewelry such as a semi-mount 306 (not shown) by the adhesive bond created when the adhesive material 3302 contacts a surface on semi-mount 306.

An ornament 202 (not shown) may first be captured in an ornament holder 102, and the temporary ornament display apparatus 100 with the ornament 202 captured therein may be coupled to the semi-mount 306. Alternatively, the temporary ornament display apparatus 100 may be coupled to the semi-mount 306 prior to the capturing of the ornament 202 in the temporary ornament display apparatus 100. This adhesive attachment embodiment may be used with various semi-mounts 306 not compatible with previous described embodiments or as an alternative to previous described embodiments. In exemplary embodiments, the adhesive material 3302 is temporary. Thus, the temporary ornament display apparatus 100 may be easily removed from the semi-mount 306.

Figure 34A:
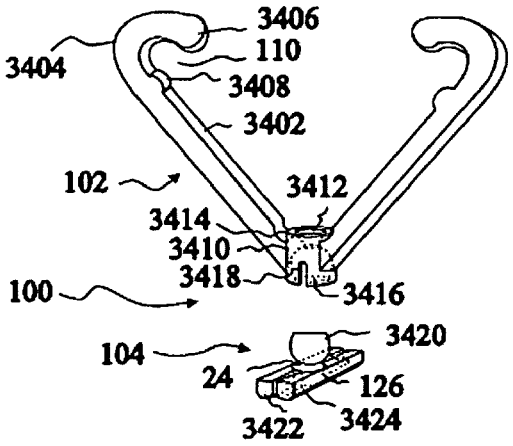
FIGS. 34*a*–*b* is another exemplary embodiment of the present invention.

FIG. 34*a* shows an alternative embodiment of the temporary ornament display apparatus 100. In this embodiment, exemplary arms 3402 and an arm head 3404 of the ornament holder 102 having generally the same uniform thickness. The arms 3402 are curved or curled at a free distal end to form the arm head 3404. A rounded distal end of the arm head 3404 forms an arm head flange 3406. Additionally, an arm head lobe 3408 is formed by a lobe on the arm 3402. Further to this embodiment, a common base 3410 comprises a funnel-shaped cavity 3412 in a base floor 3414 that extends through the base floor 3414 and into a socket 3416. On a side of the common arm base 3410 is an expansion slot 3418 to allow the common arm base 3410 to expand when engaging an arbor 3420 into the socket 3416. The exemplary arbor 3420 comprises a truncated ball that when fully engaged into the socket 3416 leaves a cavity remaining near a top of the socket 3416 between the truncated top of the arbor 3420 and the bottom of the common base floor 3414. Such a space will allow a culet 228 of a faceted ornament 202 (not shown) to extend into the space through the cavity 3412. Distal end 3422 of the spokes 3424 on bottom-inside facing distal corners of each spoke 3424 are beveled at opposing or diverging angles.

Figure 34B:
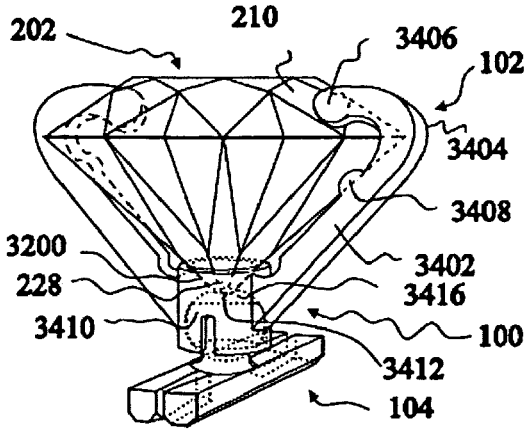

FIG. 34*b* shows an assembled version of FIG. 34*a,* with an ornament 202 displayed therein. The ornament 202 is temporarily displayed in the temporary ornament display apparatus 100 with a culet 228 of the ornament 202 extending into the cavity 3412 and further into open space between the top of the truncated arbor 3410 and the top of the socket 3416. The ornament 202 is now held in place predominantly by the arm head flange 3406 pressing downward against the crown 210 of the ornament 202 as the arms 3402 and arm head 3404 move to regain their original position. Furthermore, the engagement of the ornament cutlet 228 into the common arm base cavity 3412 helps to stabilize the ornament 202. The ornament holder 102 of FIG. 34 may be used with other jewelry article attachments 104 (e.g., other arbor or spoke configurations) to couple the temporary ornament display apparatus 100 to a semi-mount 306.

Figure 35A:
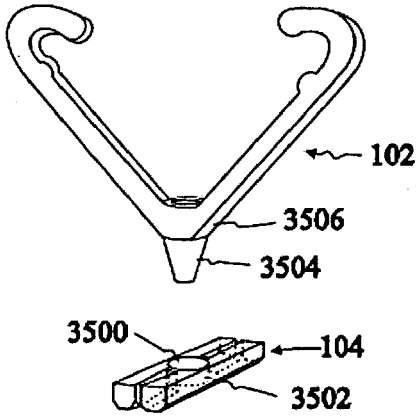
FIGS. 35*a*–*b* is a further exemplary embodiment of the present invention.
Figure 35B:
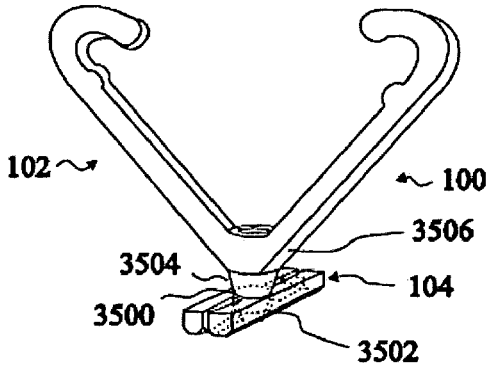

Referring now to FIGS. 35*a* and 35*b,* another alternative embodiment of a temporary ornament display apparatus 100 is illustrated. In this embodiment, the use of an arbor is removed and a cavity 3500 is formed in a hub 3502 of the jewelry article attachment 104. An ornament holder 102 having a peg 3504 extending from a common base 3506 may then be coupled to the to the jewelry article attachment 104 via insertion of the peg 3504 into the cavity 3500. In alternative embodiments, the peg and cavity configurations may vary. For example, the peg 3504 may comprise shapes such as those described in connection with FIG. 22.

The exemplary temporary ornament display apparatus 100 described herein may be manufactured in various manners and with various materials. In exemplary embodiments, the components of the temporary ornament display apparatus 100 are made via injection molding. Alternative embodiments may be made by casting and forging, for example. Furthermore, the temporary ornament display apparatus 100 may be manufactured with thermoplastics. Alternative embodiments may be made from other materials (e.g., metal) so long as the material has some flexibility and/or resilience.

The present invention has been described above with reference to exemplary embodiments. It will be apparent to those skilled in the art that various modifications may be made and other embodiments can be used without departing from the broader scope of the invention. Therefore, these and other variations upon the exemplary embodiments are intended to be covered by the present invention.

What is claimed is:

1. A temporary ornament display apparatus comprising:

an ornament holder configured to temporarily hold an ornament, the ornament holder comprising a plurality of resilient arms, the plurality of resilient arms configured to flex outward in order to receive the ornament and configured to retract towards an original position to retain the ornament; and a resilient arm head coupled to a distal end of each of the resilient arms and configured to retract towards an original position to maintain the ornament in position; and a jewelry article attachment configured to temporarily couple the ornament holder to a jewelry article, the jewelry article attachment comprising at least two sets of spokes, each set of spokes comprising two spokes coupled together at a base and configured to hold a prong of the jewelry article between the two spokes of each set of spokes.

2. The apparatus of claim 1 wherein the plurality of resilient arms comprises at least two arms.

3. The apparatus of claim 1 wherein the resilient arm head coupled to a resilient arm of the plurality of resilient arms are manufactured as a single component.

4. The apparatus of claim 1 wherein the resilient arm head comprises a notch configured for capturing a girdle of the ornament.

5. The apparatus of claim 1 wherein each resilient arm head comprises a flange configured to exert pressure against a crown of the ornament.

6. The apparatus of claim 1 wherein the ornament holder comprises a cavity in a base of the ornament holder configured to receive an arbor of the jewelry article attachment.

7. The apparatus of claim 1 wherein the ornament holder comprises a hole in a floor of a base of the ornament holder configured to allow a cutlet of the ornament to pass through.

8. The apparatus of claim 1 wherein the ornament holder comprises a funnel-shaped cavity formed in a floor of a base of the ornament holder and configured to provide stability to the ornament.

9. The apparatus of claim 1 wherein the ornament holder comprises at least two flanges coupled to a base of the ornament holder and configure to provide stability to the ornament.

10. The apparatus of claim 1 wherein the ornament holder comprises an expansion slot formed in a base of the ornament holder and configured to allow expansion of the base to couple the ornament holder to the jewelry article attachment.

11. The apparatus of claim 1 wherein the ornament holder comprises a peg extending from a base of the ornament holder and configured to couple the ornament holder to the jewelry article attachment.

12. The apparatus of claim 1 wherein the ornament holder and the jewelry article attachment are manufactured as one piece.

13. The apparatus of claim 1 wherein the jewelry article attachment comprises an arbor configured to couPle the jewelry article attachment to the ornament holder.

14. The apparatus of claim 13 wherein the arbor comprises a flange.

15. The apparatus of claim 13 wherein the arbor comprises a truncated top portion.

16. The apparatus of claim 13 wherein the arbor comprises a cavity configured to receive a cutlet of the ornament.

17. The apparatus of claim 1 wherein the spokes comprise beveled distal ends configured to facilitate alignment of prongs between the spokes.

18. The apparatus of claim 1 wherein the jewelry article attachment comprises adhesive material for coupling the ornament holder to the jewelry article.

19. The apparatus of claim 1 wherein the ornament holder is comprised of thermoplastics.

20. The apparatus of claim 1 wherein the jewelry article attachment is comprised of thermoplastics.

21. The apparatus of claim 1 wherein the plurality of resilient arms and resilient arm heads are comprised of a resilient material, the resilient material allowing for flexing of the resilient arms and resilient arm heads to create friction against the ornament in order to aid in maintaining a temporary coupling of the ornament.

22. A temporary ornament display apparatus comprising:

a jewelry article attachment configured for coupling the temporary ornament display apparatus to jewelry article using at least two sets of spokes configured to engage around a portion of the jewelry article, each set of spokes comprising two spokes coupled together at a base and configured to hold a prong of the jewelry article between the two spokes of each set of spokes; and means for temporarily coupling an ornament to an ornament holder of the temporary ornament display apparatus.

23. The apparatus of claim 22 wherein at least a portion of the means for temporarily coupling is comprised of a resilient material which flexes to create friction against the ornament in order to aid in maintaining a temporary coupling of the ornament.

24. A temporary ornament display apparatus, comprising:

an ornament holder configured to temporarily hold an ornament; and a jewelry article attachment configured to temporarily couple the ornament holder to a jewelry article, the jewelry article attachment comprising at least two sets of spokes, each set of spokes comprising two spokes coupled together at a base and configured to hold a prong of the jewelry article between the two spokes of each set of spokes.

25. The apparatus of claim 24 wherein the spokes comprise beveled distal ends configured to facilitate alignment of prongs between the spokes.

* * * * *

UNITED STATES PATENT AND TRADEMARK OFFICE

CERTIFICATE OF CORRECTION

PATENT NO. : 7,225,640 B2
APPLICATION NO. : 11/004464
DATED : June 5, 2007
INVENTOR(S) : Eugene Klotz Douglas It is certified that error appears in the above-identified patent and that said Letters Patent is hereby corrected as shown below:

In Claim 1, change lines 16-18 to read as follows:

coupled together at a base, said set of spokes extending in different angled directions from one another, and configured to hold a prong of the jewelry article between the two spokes of each set of spokes In Claim 22, change lines 6-7 to read as follows:

of spokes comprising two spokes coupled together at a base, said set of spokes extending in different angled directions from one another, and configured to hold a prong of the jewelry In Claim 24, change line 8 to read as follows:

coupled together at a base, said set of spokes extending in different angled directions from one another, and configured to hold a Signed and Sealed this Twenty-fourth Day of March, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,225,640 B2
APPLICATION NO. : 11/004464
DATED : June 5, 2007
INVENTOR(S) : Eugene Klotz Douglas It is certified that error appears in the above-identified patent and that said Letters Patent is hereby corrected as shown below:

Column 14, In Claim 1, change lines 40-42 to read as follows:

coupled together at a base, said set of spokes extending in different angled directions from one another, and configured to hold a prong of the jewelry article between the two spokes of each set of spokes Column 16, In Claim 22, change lines 8-9 to read as follows:

of spokes comprising two spokes coupled together at a base, said set of spokes extending in different angled directions from one another, and configured to hold a prong of the jewelry Column 16, In Claim 24, change line 28 to read as follows:

coupled together at a base, said set of spokes extending in different angled directions from one another, and configured to hold a This certificate supersedes the Certificate of Correction issued March 24, 2009.

Signed and Sealed this

Fourteenth Day of April, 2009

John Doll

JOHN DOLL
*Acting Director of the United States Patent and Trademark Office*